United States Patent [19]

Choi

[11] 4,317,955

[45] Mar. 2, 1982

[54] BARBED WIRE

[76] Inventor: Oh Y. Choi, 224-408 Jhamsil 2-dong, Kangnam-ku, Seoul, Rep. of Korea

[21] Appl. No.: 87,562

[22] Filed: Oct. 23, 1979

[51] Int. Cl.[3] ..... B21F 25/00

[52] U.S. Cl. ..... 174/126 CP; 174/129 R; 174/126 R; 174/119 R; 174/115; 428/602

[58] Field of Search ..... 174/126 CP, 126 R, 129 R, 174/119R, 115; 428/602

[56] References Cited

U.S. PATENT DOCUMENTS 689,615 12/1901 Heyl-Dia ..... 174/126 CP 3,697,671 10/1972 Parker ..... 174/115

FOREIGN PATENT DOCUMENTS 7534946 9/1975 France ..... 174/129

1345206 7/1971 United Kingdom ..... 174/126 CP

*Primary Examiner*—Brooks H. Hunt

*Attorney, Agent, or Firm*—Cushman, Darby & Cushman

[57] ABSTRACT

A barbed wire construction. The construction includes an iron wire having a longitudinally extending groove therein. A copper wire, coated with insulation, is inserted into the groove and extends along the groove. The iron and copper wires are coated.

3 Claims, 3 Drawing Figures

BARBED WIRE

DESCRIPTION OF THE INVENTION

This invention relates to the iron wire for the barbed wire entanglements, especially to the barbed wire, wherein the basic iron wire is cut a groove longitudinally along the surface, the fine copper wire coated with an epoxy enamel is inserted into the said groove, and then the entire surface of the iron wire is coated with a conventional zinc layer coatings.

In general, the barbed wire entanglements has being used for the hedge and fence against a thief, or to keep a military facility or the like from invading and trespassing; however, anyone who intends can easily intrude such places as guarded or encircled with a prior barbed wire entanglements by cutting them with cutter such as pincer. That is, the prior barbed wire had not a good effect against invaders; therefore, the purpose of installing the barbed wire for hedge was not achieved sufficiently by using the prior barbed wire. Eventually, the unsatisfactory effect of the prior barbed wire strongly required to hire guardman or to install an additional electrical alarming device in order to compensate the defect of the prior art. However, the electrical alarming device has also met some difficulties such as being very expensive and being exposed outside. Being exposed outside, the said electrical alarming device can be find out so easy that an invader can easily remove it or go round such device to commit a trespassing without difficulties.

Accordingly, this alarming device has become of no use in a sense. The object of this invention is to provide the improved barbed wire free from the defect described above in prior barbed wire.

According to this invention, the barbed wire is manufactured by cutting the groove longitudinally along the surface of the basic iron wire, inserting the insulted fine copper wire into the said groove, and then coating the entire surface. As the barbed wire manufactured by this procedure is similar to the prior barbed wire in external forms, if a raider cut out the barbed wire without any doubt, followed cutting out the fine copper wire, the cutting-off alarming device connected to the barbed wire begins to operate. So, the purpose of installing the barbed wire can be achieved sufficiently.

Now, this invention will be described in detail with accompanying drawings.

BRIEF DESCRIPTION OF THE INVENTION

THE PREFERRED EMBODIMENT OF THE INVENTION

Figure 1:
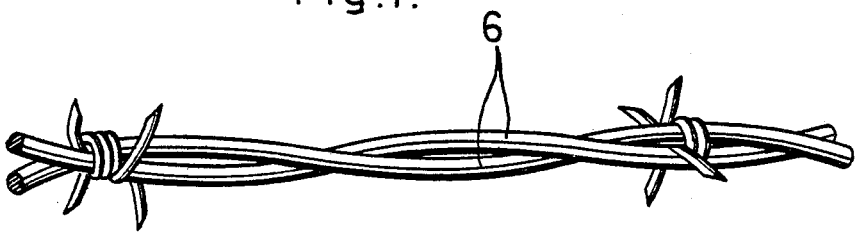
FIG. 1 is a perspective view showing the barbed wire
Figure 2:
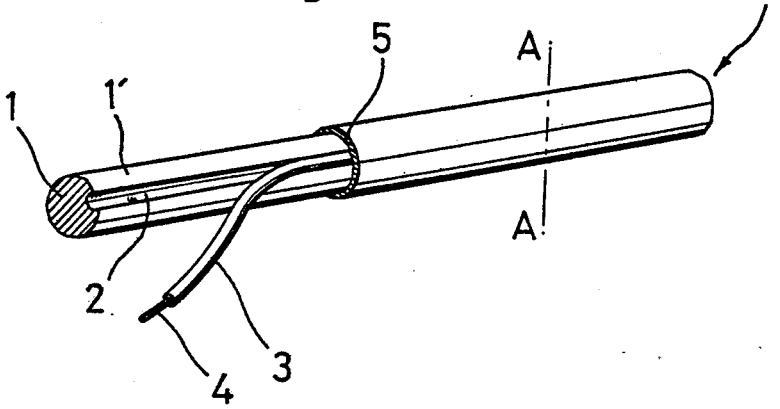
FIG. 2 is a partial perspective view showing the barbed wire of this invention
Figure 3:
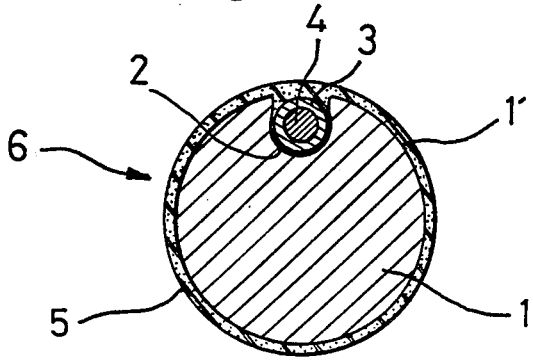
FIG. 3 is a cross-section view by cutting line A—A in FIG. 2.

This invention is composed of cutting the groove (2) longitudinally along the uneven surface (1') of the basic iron wire (1), inserting the fine copper wire (4) coated with an epoxy enamel (3) into the said groove (2) and then coating the entire surface of the wire (6) with conventional zinc layer coating (5).

To manufacture the barbed wire of this invention, the surface of the basic iron wire (1) is treated with acid to form a fire uneven surface (1') and the groove (2) is cutted longitudinally along the surface of the iron wire (1), in which a fine copper wire coated with an epoxy enamel is inserted into the said groove (2), and then a conventional zinc layer (5) is coated by the means of metallikon on the surface of the iron wire (1) to form the barbed wire entanglements similar to the prior barbed wire in the point of external.

The barbed wire of this invention, in general, is installed the same way as a prior barbed wire for a hedge. When the barbed wire is cut out, the cutting-off alarming device connected to the fine copper wire being inserted in the iron wire begins to operate. Therefore, a trespassing, invading or intruding of such places as guarded or encircled with the barbed wire of this invention can be noticed before action.

It is well-known to the expert in this art that if necessary, a plurality of copper wire can be used in this barbed wire entanglements and a lead layer coating can be used instead of zinc layer coating.

I claim:

1. A wire for a barbed wire configuration comprising an iron wire having a longitudinally extending groove therein and a copper wire coated with insulation inserted into said groove and extending along said groove, said iron wire and copper wire being coated.

2. A wire as in claim 1, wherein said insulation is an epoxy enamel.

3. A wire as in claim 1 or 2, wherein said iron wire and copper wires are coated with zinc.

* * * * *